United States Patent [19]

Crase

[11] 4,452,472

[45] Jun. 5, 1984

[54] TUBULAR SAFETY JOINT FOR DRILL STRINGS

[75] Inventor: Gary M. Crase, Cypress, Calif.

[73] Assignee: Smith International Inc., Newport Beach, Calif.

[21] Appl. No.: 297,187

[22] Filed: Aug. 28, 1981

[51] Int. Cl.[3] ..... F16L 37/00; F16L 55/00; F16L 39/00

[52] U.S. Cl. ..... 285/3; 285/18; 285/319; 285/DIG. 23

[58] Field of Search ..... 285/3, 4, 18, 319, DIG. 23

[56] References Cited

U.S. PATENT DOCUMENTS

| | | | |
|---|---|---|---|
| 2,307,275 | 1/1943 | Johnson | 285/DIG. 23 |
| 3,051,244 | 8/1962 | Litchfield | 285/18 X |
| 4,161,216 | 7/1979 | Amancharla | 285/DIG. 23 |

*Primary Examiner*—Richard J. Scanlan, Jr.

*Attorney, Agent, or Firm*—Philip Subkow; Gabor L. Szekeres

[57] ABSTRACT

A releasable coupling or safety sub for a drill string including an inner tubular member piloted within an outer tubular member, the inner member including expansible lock members shiftable laterally of the tubular member into locking engagement with a transverse shoulder on the outer member, a retaining member holding the lock members outwardly in engagement with the shoulder, release of the retainer member from the lock members enabling the latter to move laterally inwardly to a position released from the shoulder, permitting the tubular members to be separated from one another. The coupling includes a device acting between the lock members and outer member for imposing an axial preload on the inner and outer members to place the outer member in compression and the inner member in tension to provide a rigid structure.

8 Claims, 6 Drawing Figures

TUBULAR SAFETY JOINT FOR DRILL STRINGS

The present invention relates to safety joints or releasable couplings, and more particularly to releasable couplings to be embodied in a drill string attached to a drill bit used in drilling a bore hole in earth formations.

As disclosed in FIG. 4 of U.S. Pat. No. 3,148,894, a safety, releasable joint is embodied in a drill string connected to a drill bit for use in drilling a bore hole in earth formations. In the event the drill bit or drill pipe becomes stuck in the well bore, the safety joint can be released and the upper portion of the drill string separated from the lower portion and withdrawn to the top of the well bore. The particular safety joint illustrated in the patent is inordinately lengthy, which creates problems in the event of its use in conjunction with a subsurface fluid motor and a bent sub in performing directional drilling operations in a well bore.

The safety joint shown in FIG. 4 of the above patent does not have its coengaging parts fitting tightly to one another, resulting in the parts being in a slack condition and subject to relative movement with respect to one another, which can create difficulties in proper operations of the safety joint.

Applicant's safety joint or releasable coupling is relatively compact, which enables the coupling to be made shorter. Moreover, it is axially preloaded, which insures tightness between its coengaging parts. Applicant's releasable coupling embodies an upper inner tubular member telescoped within a lower outer member having interengaging parts for transmitting torque between the members. The outer member has a transverse shoulder and carries circumferentially spaced lock members shiftable transversely to a position engaging the transverse shoulder, so that the inner member can exert an upward force on the lock members and against the transverse shoulder. The inner and outer members have thrust surfaces engaging each other, such that downward thrust is transmitted from the inner member to the outer member.

The lock members are held in thrust transmitting engagement with the transverse shoulder by a retainer member which prevents the segmental lock members from shifting laterally inwardly free from engagement with the tapered shoulders. Removal of the retainer member from the lock members enables the latter to improve inwardly clear of the transverse shoulder. The drill pipe connected to the inner member and disposed above the inner member can then be elevated for complete removal from the well bore.

A preload device is embodied in the outer member to impose an axial preload between the lock members and the transverse shoulder and a compressive force between the inner and outer members to prevent any slack from remaining in the assembled tool.

This invention possesses many other advantages, and has other purposes which may be made more clearly apparent from a consideration of a form in which it may be embodied. This form is shown in the drawings accompanying and forming part of the present specification. It will now be described in detail, for the purpose of illustrating the general principles of the invention; but it is to be understood that such detailed description is not to be taken in a limiting sense.

REFERRING TO THE DRAWINGS

Figure 2:
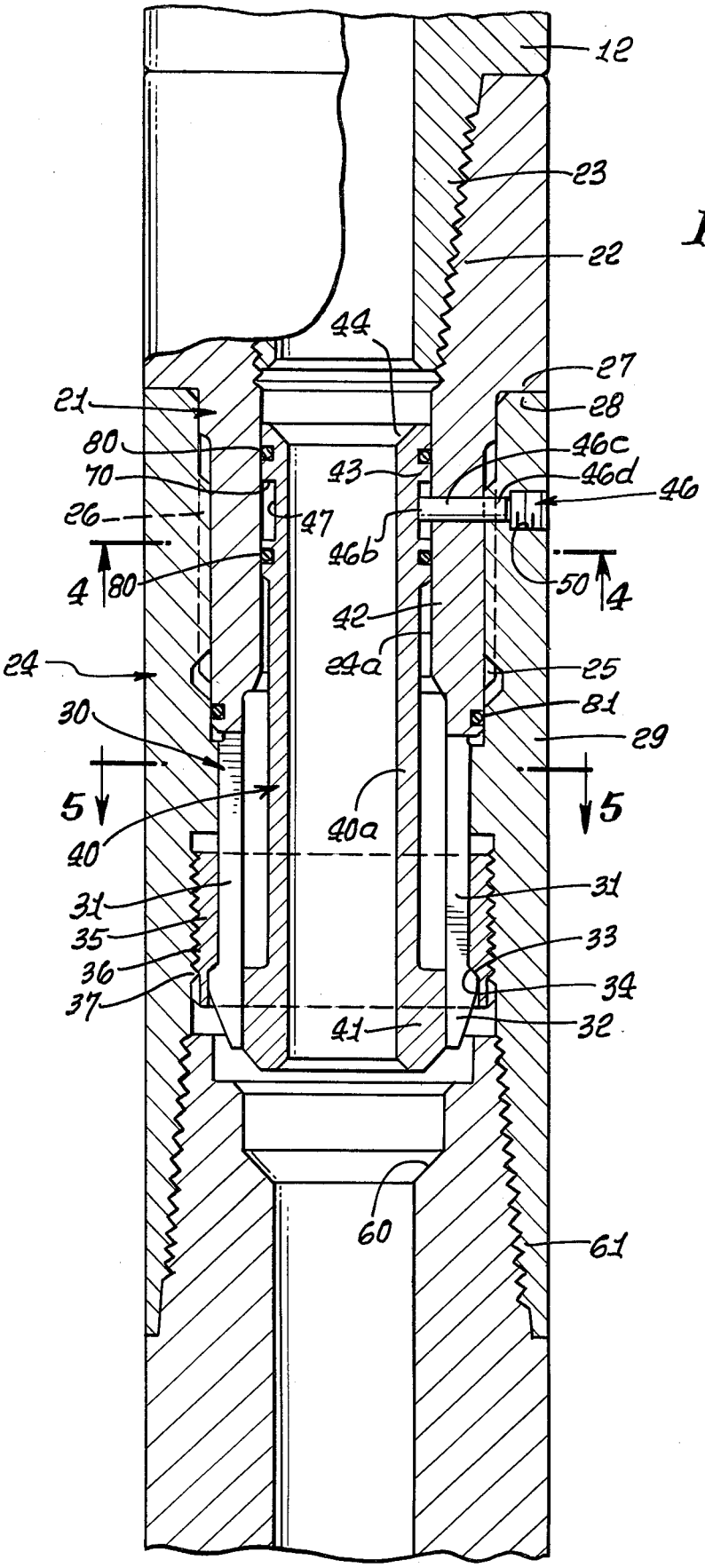
FIG. 2 is an enlarged side elevational view and longitudinal section taken along the line 2—2 on FIG. 1.
Figure 3A:
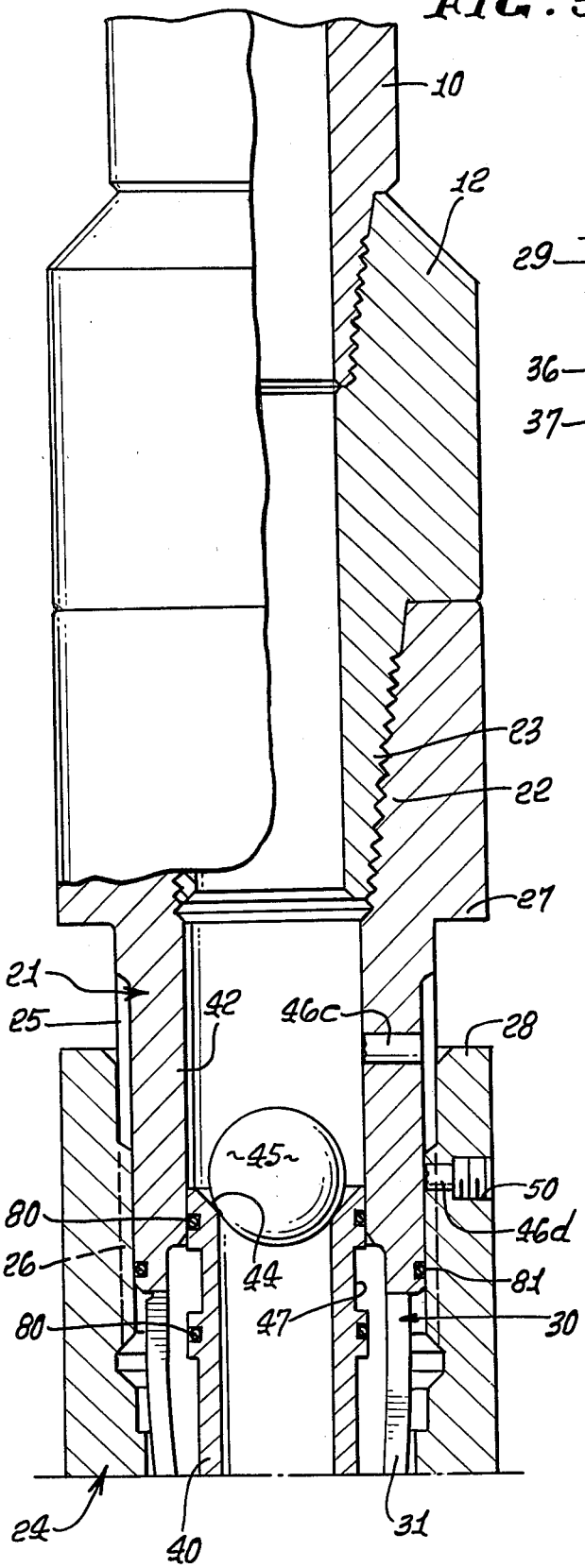
Figure 3B:
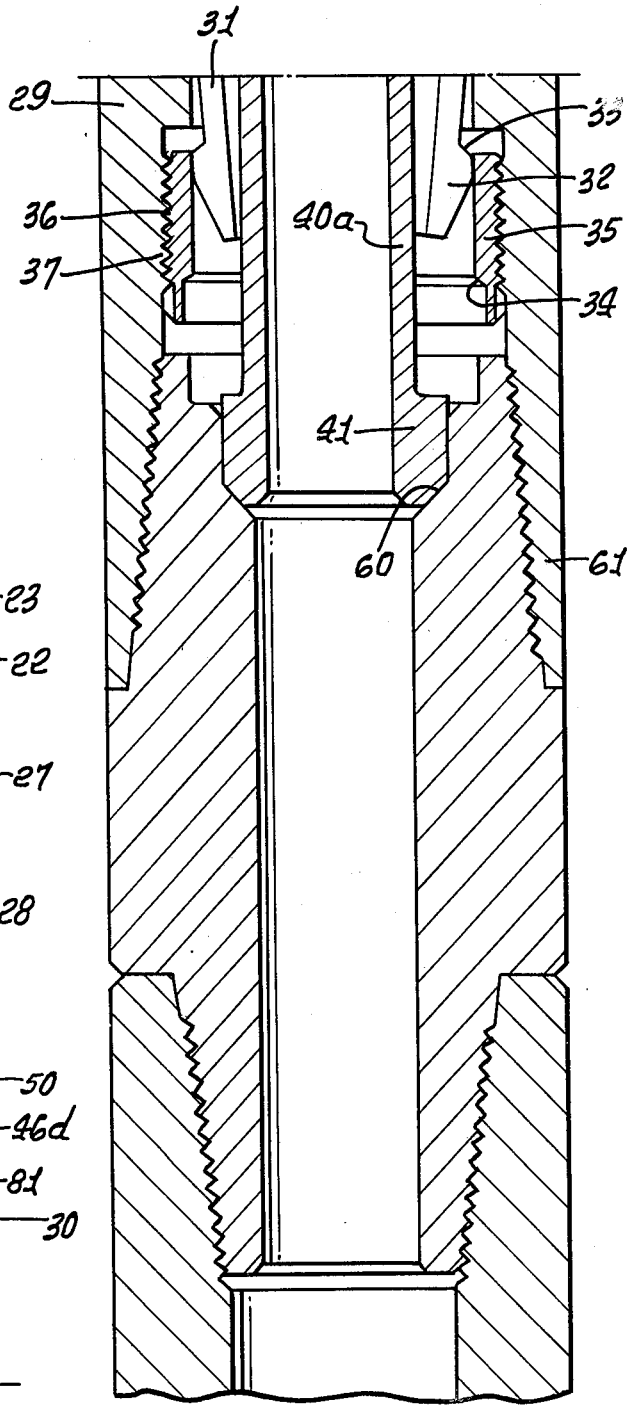

FIGS. 3*a* and 3*b* are views corresponding to FIG. 2, with the safety joint or releasable coupling in a released condition for removal of the drilling string to the top of the well bore, FIG. 3*b* being a lower continuation of FIG. 3*a;*

Figure 4:
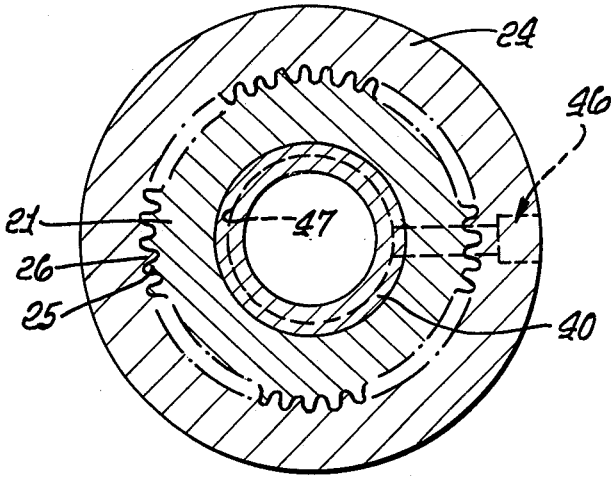

FIG. 4 is a cross-section taken along the line 4—4 of FIG. 2; and

Figure 5:
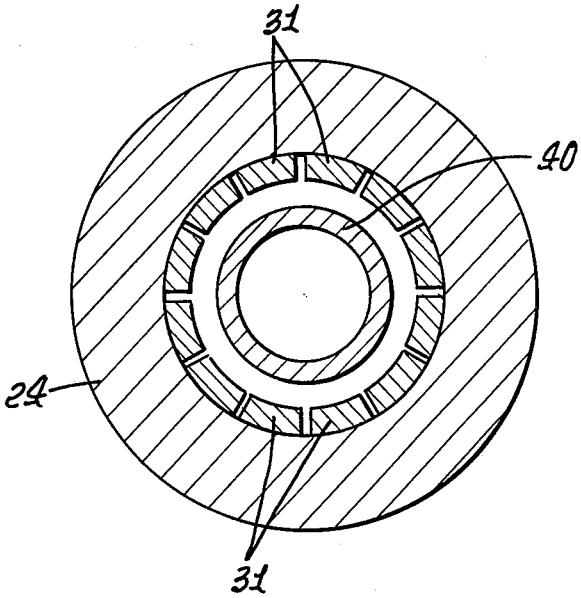

FIG. 5 is a cross-section taken along the line 5—5 on FIG. 2.

Figure 1:
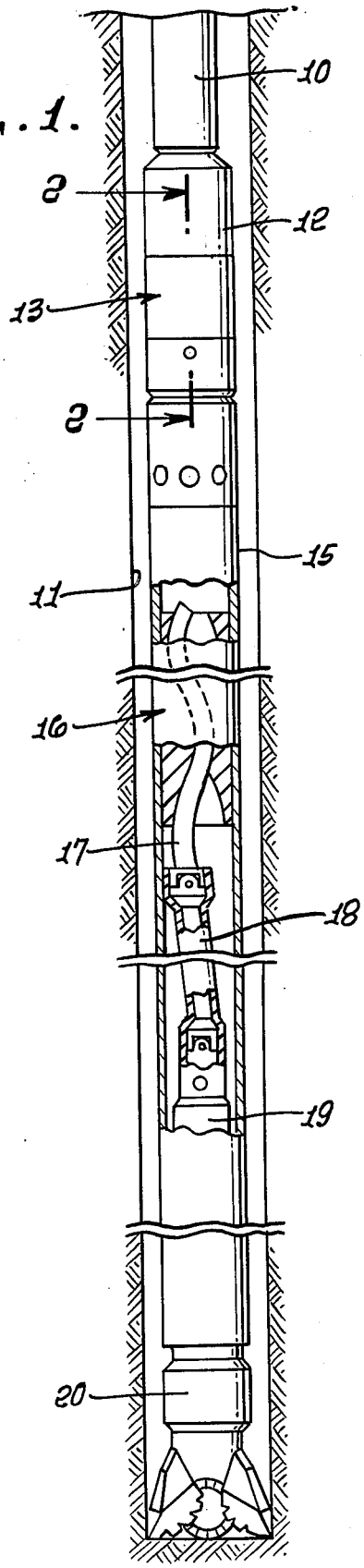
FIG. 1 is a combined side elevational and longitudinal sectional view through a combination of a drill bit, fluid motor, dump valve, safety joint and bent sub for drilling a well bore.

As disclosed in FIG. 1, a drill collar or drill pipe 10, forming the lower portion of a drill pipe string extending to the top of a well bore 11 being drilled, is secured to a bent sub 12, such as disclosed in U.S. Pat. No. 4,067,404. The sub 12 is secured to the upper end of a releasable coupling or safety joint 13 connected to a dump valve 14, which may be the type illustrated in U.S. Pat. No. 3,005,507, which is, in turn, secured to the upper end of the stator portion 15 of a fluid motor 16 containing a rotor 17. The rotor is connected to a universal joint 18 connected to the drive shaft 19 of the motor, which is secured at its lower end to a drill bit 20 for drilling the well bore 11 to the desired diameter. The drive shaft is suitably rotatably supported, in a known manner, by a bearing asembly (not shown) contained within the stator and through which drilling weight is transmitted to the drill bit 20, and to the bottom of the bore hole. The details of the drill bit, bearing assembly, universal joint, stator, rotor, dump valve, and bent sub are not presented, since they are devices well known to the average person skilled in the art. However, the releasable coupling or safety joint 13 is not known, being disclosed specifically in FIGS. 2 to 5, inclusive.

The releasable coupling includes an upper inner housing member 21 having a threaded box 22 receiving a companion threaded pin 23 of the bent sub 12. The inner tubular member is piloted within an outer tubular housing member 24, torque being transmitted between the members through longitudinal external splines 25 on the inner member meshing with companion internal splines 26 on the outer member. As disclosed in FIG. 2 of the drawings, the upper inner member 21 has a downwardly facing transverse shoulder 27 engaging the transverse upper end 28 of the outer member to transmit downward thrust from the upper inner member to the lower outer member. The inner member has a collet portion 30 including spring-like collet arms 13 circumferentially spaced from one another, which are integral with the lower collet fingers 32, the fingers having upper thrust surfaces 33 tapering in an upward and inward direction adapted to be engaged with a circumferential tapered shoulder 34 on a sleeve member 35 having external threads 36 meshing with companion internal threads 37 in the outer member 29. An upward pull can be taken on the inner member which is transmitted through the tapered surfaces of the collet fingers to the tapered shoulder and through the external threads on the sleeve member to the internal threads meshing therewith and provided on the outer member. Thus, upward thrusts are transmitted through the upper portion of the inner member 21 through the collet arms 31 to the sleeve member 35 and through the threaded connection 36, 37 to the outer member 29. Downward thrusts are transmitted directly from the inner member to the outer member, passing from the transverse shoulder 27 of the upper member to the transverse upper end 28 of the outer member.

The collet fingers 32 are retained under the transverse shoulder 33 of the sleeve member 35 by a piston or retaining member 40 having a lower holding head 41 thereon disposed behind the collet fingers 32, and thereby preventing such fingers from expanding inwardly and out of engagement from the transverse shoulder 33. This retaining member 40 extends upwardly from the holding head and along the upper circumferentially continuous portion 42 of the inner member, terminating in an upper piston 43 that has an upper seat 44 adapted to be engaged by a suitable trip member or ball 45 when fluid is to be prevented from passing downwardly through the piston retaining member or sleeve 40. The piston is prevented from moving downwardly of the upper inner member to any significant extent by a shear pin 46*c* extending radially through the upper portion of the outer member, through the inner member 42 and extending inwardly beyond the inner surface 24*a* of the inner member and into a peripheral groove 47 provided on the piston head 43. The shear pin is retained by a pipe plug 46, threaded into a bore 50 in the outer member to be assured that the inner end of the pin extends into the peripheral groove 47. The piston can move axially to a limited extent because of the length of the peripheral groove. However, it cannot move sufficiently as to remove the lower head 41 from retaining engagement behind the collet fingers 32.

It is to be noted that the intermediate portion 40*a* of the retaining piston or sleeve 40 extending between the lower holding head 41 and the upper piston head 43 is of substantially reduced peripheral diameter, to allow the collet fingers 32 to spring inwardly completely clear of the transverse shoulder 33 upon downward shifting of the piston retaining sleeve along the collet arms 31 and fingers 32, to shift the retainer holding head 41 downwardly below the collet fingers 32, permitting such fingers and the collet arms attached thereto to be shifted or deflected laterally inwardly and free from engagement with the transverse shoulder 34. The piston sleeve can shift downwardly until it engages a stop shoulder 60 in a lower sub that has an upper threaded pin threadedly engaging a box 61 at the lower end of the outer tubular member 29.

The threaded sleeve member 35 can be turned relative to the outer member 29 to cause its tapered shoulder 34 to shift in a downward direction and exert a downwardly directed thrust on the upper finger shoulders 33, which is transmitted through the arms 31 and the upper portion 42 of the inner member to the transverse shoulder 27 of the inner member. At the same time, the threaded sleeve member 35 exerts an upward compressive force through the threaded connection 36, 37 on the outer member 29. Thus, the threaded sleeve 35 can exert a preload tension on the collet fingers 32, arms 31 and inner member 24, and a compressive force from the threaded sleeve 35 through the lower outer member 29 to the upper end 28 of the outer member. The tensile force on the inner member 21 and the compressive force on the outer member 29 preloads the abutting transverse surfaces 27, 28. At the same time, the coengaged tapered shoulder 34 and upper tapered surfaces 33 on the collet fingers 32 are preloaded. With the preload imposed on the inner and outer members 21, 29, the tension in the inner member and the compression in the outer member maintains the thrust engaging surfaces in a tight or preloaded condition.

In the event it is desired to disconnect the inner tubular member from the outer tubular member, a tripping member 45, such as a ball, is lowered through the drill string, or allowed to gravitate through the drilling fluid in the drill string, until it comes into engagement with its companion seat 44 on the piston or retaining sleeve 40. Pressure is then applied to the fluid in the drill string, moving the sleeve 40 downwardly to place its shoulder 70 in engagement with the inner end of the shear pin 46. When the pressure exceeds the shear value of the pin 46, the inner end portion 46*b* of the pin is sheared from the remainder of the shear pin, releasing the sleeve 40 and shifting it downwardly until the lower retainer or holding head 41 is completely free from the collet fingers 32 (FIGS. 3*a*, 3*b*). An upward pull is then taken on the drill string above the safety sub 13, which is transmitted through the inner member 21, collar arms 31 and fingers 33, the collet fingers moving upwardly along the tapered shoulder 34 and being cammed inwardly to a position disengaged from the tapered shoulder. Before that occurs, a sufficient upward strain must be taken on the drill string and the inner member to shear the intermediate portion 46*c* of the shear pin from its outer portion 46*d*, enabling upward movement of the inner member to continue and effect the inward camming of the collet fingers 32 from the tapered shoulder 34 on the preload sleeve member 35, the collet 35 fingers then being free to slide upwardly along the sleeve member and along the inner surfaces of the outer lower member 29 to completely remove the inner member 21 from the outer member, permitting the drill string above the inner member and the inner member itself to be elevated in the well bore and withdrawn at the top thereof.

Fluid leakage between the retaining sleeve 40 and the inner member 21 is prevented by seal rings 80 on the sleeve on opposite sides of the shear pin 46 slidingly engaging the inner member 21. Leakage of fluid between the inner and outer members is prevented by the seal ring 81.

The safety sub disclosed in the drawings is more compact and shorter in overall length than safety subs of the prior art, such as the safety sub disclosed in FIG. 4 of U.S. Pat. No. 3,148,894. This is of importance in connection with the use of a downhole motor in drilling bore holes in earth formations, such as oil and gas wells. Such well bores are sometimes drilled directionally and used with a bent sub 12 above the fluid motor in controlling the angle at which the well bore being drilled is to deviate. If a safety sub is to be connected in the drill string below a bent sub, or the like, the use of relatively lengthy safety subs, as disclosed in the prior art, increases the distance between the bent sub and the downhole motor, resulting in difficulties in slant drilling the well bore to the desired extent. The overlapping arrangement of the parts disclosed in the present application and in applicants companion case for "Releasable Couplings For Drill Strings", Ser. No. 298,023, filed Aug. 31, 1981, enables the safety joint to be made substantially shorter and reduces the distance between the bent sub and the downhole motor.

Additionally, the parts of the safety joint as disclosed in the present drawings are maintained in a tight condition because of the preloading that can be imposed on the several contacting parts, which insures against looseness between the parts in a thrust transmitting direction while the safety joint is intact.

I claim:

1. A safety joint for a tubular string adapted to be disposed in a well bore, comprising a lower outer tubular member having a transverse shoulder, an upper inner tubular member telescopically disposed in said outer member, a transverse shoulder disposed on said inner tubular member mating with said first named shoulder, a lock member carried by said inner member and shiftable laterally into a position for engagement with an inner shoulder on said lower tubular member to transmit upwardly directed axial thrusts from said lock member to said first named shoulders, a retaining member having a lower head disposed behind said lock member to prevent said lock member from retracting inwardly away from said inner shoulder, said retaining member extending upwardly from said lock member along said inner tubular member and supported by said inner tubular member, said retaining member having a lesser diameter above said head than the diameter of said head, and means for moving said retaining member downwardly along said inner tubular member and from holding engagement with said lock member to enable said lock member to retract laterally inwardly from said inner shoulder and toward said lesser diameter portion of said retaining member to permit upward movement of said upper tubular member from said lower tubular member, external longitudinal splines on the inner tubular member, nesting internal longitudinal splines on the outer tubular member said splines positioned between said transverse shoulders and said lock member.

2. A safety joint for a tubular string adapted to be disposed in a well bore, comprising a lower outer tubular member having a transverse inner shoulder, an inner tubular member telescopically disposed in said outer member, lock members carried by said inner member and shiftable laterally into a position for engagement with said shoulder to transmit upwardly directed axial thrusts from said lock members to said shoulder, a retaining member having a lower head disposed behind said lock members to prevent said lock members from retracting inwardly away from said shoulder, said retaining member extending inwardly from said lock members along said inner member and supported by said inner member, said retaining member having a lesser diameter above said head than the diameter of said head, and means for moving said retaining member downwardly along said inner member and from holding engagement with said lock members to enable said lock members to retract laterally inwardly from said shoulder and toward said lesser diameter portion of said retaining member to permit upward movement of said upper member from said lower member, and releasable means preventing said retaining member from moving from holding engagement with said lock member, said releasable means comprising one or more shear pins mounted in said inner member and engageable by a portion of said retaining member above said lock members to disrupt said one or more shear pins, said one or more shear pins connecting said tubular members together to prevent telescopic movement between said members, an outer portion of said one or more shear pins being disruptable in response to upward thrust of said inner member to permit telescopic movement of said inner member relative to said outer member.

3. A safety joint for a tubular string adapted to be disposed in a well bore, comprising a lower outer tubular member having a transverse inner shoulder, an inner tubular member telescopically disposed in said outer member, lock members carried by said inner member and shiftable laterally into a position for engagement with said shoulder to transmit upwardly directed axial thrusts from said lock members to said shoulder, a retaining member having a lower head disposed behind said lock members to prevent said lock members from retracting inwardly away from said shoulder, said retaining member extending upwardly from said lock members along said inner member and supported by said inner member, said retaining member having a lesser diameter above said head than the diameter of said head, and means for moving said retaining member downwardly along said inner member and from holding engagement with said lock members to enable said lock members to retract laterally inwardly from said shoulder and toward said lesser diameter portion of said retaining member to permit upward movement of said upper member from said lower member; said outer tubular member including a sleeve on which said transverse inner shoulder is provided, and means adjustably mounting said sleeve on an adjacent portion of said outer tubular member to provide a tight fit of said shoulder against said lock members.

4. A safety joint as defined in claim 3; said adjustable mounting means comprising a thread on said sleeve meshing with a companion thread on said adjacent portion of said outer member.

5. A safety joint for a tubular string adapted to be disposed in a well bore, comprising a lower outer tubular member having a transverse inner shoulder, an upper inner tubular member telescopically disposed in said outer member, lock members carried by said inner member and shiftable laterally into a position for engagement with said shoulder to transmit upwardly directed axial thrusts from said lock members to said shoulder, a retaining member disposed behind said lock members to prevent said lock members from retracting inwardly away from said shoulder, means for moving said retaining member downwardly along said inner member and from holding engagement with said lock members to enable said lock members to retract inwardly from said shoulder and permit upward movement of said upper member from said lower member, said outer tubular member including a sleeve on which said transverse inner shoulder is provided, and means adjustably mounting said sleeve on an adjacent portion of said outer tubular member to provide a tight fit of said shoulder against said lock members.

6. A safety joint as defined in claim 5; said adjustable mounting means comprising a thread on said sleeve meshing with a companion thread on said adjacent portion of said outer member.

7. A releasable coupling for a tubular string comprising an outer tubular member, an inner tubular member telescopically positioned in said outer tubular member, means for coupling said inner and outer tubular member in said tubular string, collet fingers connected to said inner tubular member and engaging a shoulder on said outer tubular member, a piston sleeve telescopically positioned in said inner tubular member, said piston sleeve formed with a holding section for said collet fingers in engagement with said shoulder to lock together said inner and outer tubular members, a shear pin between said inner and outer members and said piston sleeve.

8. A releasable coupling for a tubular string comprising an outer tubular member, an inner tubular member telescopically positioned in said outer tubular member means for coupling said inner and outer tubular members in said tubular string, collet fingers connected to said inner tubular member and engaging a shoulder on said outer tubular member, a piston sleeve telescopically positioned in said inner tubular member, said piston sleeve formed with a holding section for said collet fingers in engagement with said shoulder to lock together said inner and outer tubular members, a sleeve containing said shoulder and axially adjustably mounted on said outer tubular member.

* * * * *

UNITED STATES PATENT AND TRADEMARK OFFICE

CERTIFICATE OF CORRECTION

PATENT NO. : 4,452,472

DATED : June 5, 1984

INVENTOR(S) : Gary M. Crase

It is certified that error appears in the above-identified patent and that said Letters Patent are hereby corrected as shown below:

Column 1, line 50, change "improve" to --move--.

Column 2, line 54, change "13" to --31--.

Column 4, line 63, change "#298023" to --#298223--.

Column 5, line 46, change "inwardly" to --upwardly--.

Signed and Sealed this

*Nineteenth* Day of *February 1985*

[SEAL]

*Attest:*

DONALD J. QUIGG

*Attesting Officer* *Acting Commissioner of Patents and Trademarks*